US009494104B2

(12) United States Patent
Westhoff, Jr. et al.

(10) Patent No.: US 9,494,104 B2
(45) Date of Patent: Nov. 15, 2016

(54) CYLINDER WITH MULTIPLE TRANSFER PORTS FOR AN INTERNAL COMBUSTION ENGINE

(71) Applicant: BRP US INC., Sturtevant, WI (US)

(72) Inventors: Paul Westhoff, Jr., Kenosha, WI (US); Justin Johnson, Silver Lake, WI (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 14/054,739

(22) Filed: Oct. 15, 2013

(65) Prior Publication Data

US 2014/0102400 A1 Apr. 17, 2014

Related U.S. Application Data

(60) Provisional application No. 61/713,742, filed on Oct. 15, 2012.

(51) Int. Cl.
*F02B 33/04* (2006.01)
*F02F 1/18* (2006.01)
*F02F 1/22* (2006.01)

(52) U.S. Cl.
CPC .. *F02F 1/18* (2013.01); *F02F 1/22* (2013.01)

(58) Field of Classification Search
CPC ..... F02B 2075/025; F02B 25/14; F02B 1/22; F02F 1/18; F02F 1/228
USPC ..... 123/65 P, 73 PP, 65 E, 65 A
See application file for complete search history.

(56) References Cited

U.S. PATENT DOCUMENTS 3,815,558 A * 6/1974 Tenney ..... 123/73 A
4,167,160 A * 9/1979 Matsushita et al. ..... 123/73 A
4,202,299 A * 5/1980 Boyesen ..... 123/73 A
4,248,185 A * 2/1981 Jaulmes ..... 123/73 R
4,294,202 A * 10/1981 Boyesen ..... 123/73 PP
4,395,978 A * 8/1983 Boyesen ..... 123/73 R
4,414,928 A * 11/1983 Nakada ..... 123/73 PP
5,205,245 A * 4/1993 Flack et al. ..... 123/65 P
5,870,981 A * 2/1999 Knaus et al. ..... 123/65 A
6,161,509 A * 12/2000 Dahlberg et al. ..... 123/73 PP
6,318,311 B1 * 11/2001 Kikuchi ..... 123/73 PP
2004/0182339 A1 * 9/2004 Geyer et al. ..... 123/73 PP
2007/0163557 A1 * 7/2007 Layher et al. ..... 123/73 PP

OTHER PUBLICATIONS

Zeng et al., Modeling of Air-Fuel Mixing in a Two-Stroke Direct Injection Engine, SAE Paper, 2003-01-3103, 2003.
Jante, A., Scavenging and Other Problems of Two-Stroke Cycle Spark-Ignition Engine, SAE Paper, 680468, pp. 1803-1824, 1968.

* cited by examiner

*Primary Examiner* — Marguerite McMahon
(74) *Attorney, Agent, or Firm* — BCF LLP

(57) ABSTRACT

A cylinder comprises a cylinder axis, a cylindrical wall, and an exhaust port defined in the wall. At least one central transfer port and at least two side transfer ports are defined in the wall. Each of the at least one central transfer port and each of the at least two side transfer ports has a transfer channel extending therefrom. For each of the at least one central transfer port, an angle about the cylinder axis between a center of the central transfer port and a center of the exhaust port is greater than 135° and less than or equal to 180°. For each of the at least two side transfer ports, an angle about the cylinder axis between a center of the side transfer port and the center of the exhaust port is less than or equal to 135°. Engines and cylinder blocks are also disclosed.

19 Claims, 10 Drawing Sheets

CYLINDER WITH MULTIPLE TRANSFER PORTS FOR AN INTERNAL COMBUSTION ENGINE

CROSS-REFERENCE

The present application claims priority to U.S. Provisional Application No. 61/713,742 filed on Oct. 15, 2012, the entirety of which is incorporated herein by reference.

FIELD OF THE INVENTION

The present invention relates to internal combustion engines. More specifically, the present invention relates cylinders for internal combustion engines.

BACKGROUND

Increasingly stringent regulations for two-stroke engines necessitate a reduction in emissions. Emissions reduction techniques have so far included engine calibration strategies using injection timing to minimize lost fuel at the expense of mixture preparation and power. Traditional calibration strategies for reducing emissions focus on timing the Start of Injection (SOI) to minimize the amount of lost fuel. Since injection occurs during cylinder scavenging, the path the fuel cloud takes is strongly influenced by the scavenging pattern produced by the transfer ports. The flow pattern which provides good power performance in carbureted engines also convects fuel spray toward the exhaust port in the direct injection engine. These fuel losses can be minimized by allowing less time for the scavenging flows to convect fuel to the exhaust port. However, this strategy also reduces the amount of time for the fuel spray to mix with the air delivered during scavenging resulting in a reduced power output.

It would be desirable to further reduce these fuel losses out of the exhaust port without excessively degrading mixture preparation and trapped oxygen. It is therefore desirable to optimize the scavenging pattern to maximize fuel trapping without sacrificing mixture preparation.

It would be desirable to have a two-stroke, direct injection, internal combustion engine with reduced emissions, increased power output and improved fuel economy. It would also be desirable to achieve these results without increasing the size of the bore, bore spacing or stroke of the engine compared to that of current generation engines in order to remain within the current constraints of cost, weight, commonality, and engine envelope targets.

SUMMARY

It is an object of the present invention to ameliorate at least some of the inconveniences present in the prior art.

In one aspect, a cylinder for an internal combustion engine is provided. The cylinder comprises a cylinder axis, a cylindrical wall, and an exhaust port defined in the wall. At least one central transfer port is defined in the wall. Each of the at least one central transfer port has a transfer channel extending therefrom. For each of the at least one central transfer port, an angle about the cylinder axis between a center of the central transfer port and a center of the exhaust port is greater than 135° and less than or equal to 180°. At least two side transfer ports are defined in the wall. Each of the at least two side transfer ports has a transfer channel extending therefrom. For each of the at least two side transfer ports, an angle about the cylinder axis between a center of the side transfer port and the center of the exhaust port is less than or equal to 135°.

In another aspect, for each of the at least two side transfer ports, the corresponding transfer channel has at least one wall adapted to guide air flow into the cylinder towards the at least one central transfer port.

In another aspect, for each of the at least one central transfer port, the corresponding transfer channel has at least one wall adapted to direct air flow into the cylinder toward the exhaust port.

In an additional aspect, each transfer channel is defined by an outer surface of the cylinder adjacent to the corresponding one of the at least one central transfer port and at least two side transfer ports, two side walls extending from a periphery of the corresponding one of the at least one central transfer port and at least two side transfer ports, a rear wall extending between the two side walls and spaced from the outer surface, and an upper wall extending from the periphery of the corresponding one of the at least one central transfer port and at least two side transfer ports between the two side walls and the rear wall.

In a further aspect, for each transfer channel: the rear wall and the two side walls extend generally parallel to the cylinder axis.

In another aspect, for each transfer channel corresponding to the at least two side transfer ports, a first portion of one of the two side walls extends parallel to a plane defined by the cylinder axis and the center of the exhaust port.

In yet another aspect, for each transfer channel corresponding to the at least two side transfer ports, the one of the two side walls has a second portion extending between the first portion and the corresponding side transfer port. A chord is defined by the periphery of the corresponding side transfer port in a plane normal to the cylinder axis and containing the center of the corresponding side transfer port. An angle between the second portion and the chord is less than or equal to 90°.

In a further aspect, for each transfer channel corresponding to the at least two side transfer ports, the two side walls converge towards one another as they extend toward the rear wall.

In a further aspect, for each transfer channel corresponding to the at least two side transfer ports, at least a portion of the other of the two side walls extends parallel to the one of the two side walls. In another aspect, the rear wall is perpendicular to the two side walls.

In a further aspect, for each transfer channel corresponding to the at least two side transfer ports, an angle between the upper wall and the rear wall is greater than 90°.

In a further aspect, the at least one central transfer port includes a left central transfer port and a right central transfer port disposed circumferentially symmetrically with respect to the exhaust port.

In a further aspect, the angle about the cylinder axis between the centers of the left central transfer port and the right central transfer port is less than 90°.

In an additional aspect, the at least two side transfer ports include a left side transfer port and a right side transfer port disposed circumferentially symmetrically with respect to the exhaust port. For each of the left side transfer port and the right side transfer port, the angle about the cylinder axis between the centers of the exhaust port and the side transfer port is less than 90°.

In an additional aspect, the surface area of each of the at least two side transfer ports is larger than the surface area of each of the at least one central transfer port.

In yet another aspect, the at least one central transfer port is one central transfer port, and the angle about the cylinder axis between the center of the exhaust port and the center of the central transfer port is 180°.

In a further aspect, the at least two side transfer ports includes a first left side transfer port, a first right side transfer port, a second left side transfer port, and a second right side transfer port. The first left side transfer port and the first right side transfer port are disposed circumferentially symmetrically with respect to the exhaust port. The second left side transfer port and the second right side transfer port are disposed circumferentially symmetrically with respect to the exhaust port.

In a further aspect, the angle about the cylinder axis between the centers of the exhaust port and each of the first left side transfer port and the first right side transfer port is less than 90°, and the angle about the cylinder axis between the centers of the exhaust port and each of the second left side transfer port and the second right side transfer port is greater than 90°.

In another aspect, each of the first right side transfer port and the left side transfer port has a larger surface area than each of the second right side transfer port and the second left side transfer port.

In yet another aspect, the centers of each of the at least one central transfer port and each of the at least two side transfer ports are aligned in a direction parallel to the cylinder axis.

In a further aspect, an internal combustion engine is provided. The engine includes at least one cylinder as described above. A crankcase is connected to the at least one cylinder. An intake port is fluidly connected to the crankcase. A cylinder head is connected to the at least one cylinder. The engine further includes, for each of the at least one cylinder, a piston disposed inside the cylinder and adapted to reciprocate along the cylinder axis. A combustion chamber is defined by the cylinder, the piston and the cylinder head. A fuel injector is fluidly connected to the combustion chamber. A spark plug is disposed at least in part in the combustion chamber. The at least one central transfer port and the at least two side transfer ports selectively connecting the crankcase with the combustion chamber.

In a further aspect, the at least one cylinder comprises at least two adjacent cylinders. The at least two adjacent cylinders are disposed such that their respective cylinder axes are parallel to one another. Lines connecting the centers of the exhaust ports with their corresponding cylinder axes are normal to a plane defined by the cylinder axes of the at least two the adjacent cylinders.

In an additional aspect, a cylinder block for an internal combustion engine includes a crankcase having a central axis and a plurality of cylinders according to any one of the aspects described above. The cylinder axes of the plurality of cylinders defining a plane. The plane contains the central axis of the crankcase. The crankcase is connected to each of the transfer channels corresponding to each of the at least one central transfer port and each of the at least two side transfer ports.

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

An engine 2, cylinder block 10 and a cylinder 12 for a direct injection, two-stroke, internal combustion engine 2 will be described herein with reference to FIGS. 1 to 8B.

The illustrated engine 2 is a 3.4 liter, V6 engine rated for 200 to 300 horsepower. It is however contemplated that aspects of the invention described below could also be used in other types of engines, such as, but not limited to, carbureted or semi-direct injection engines.

Figure 1B:
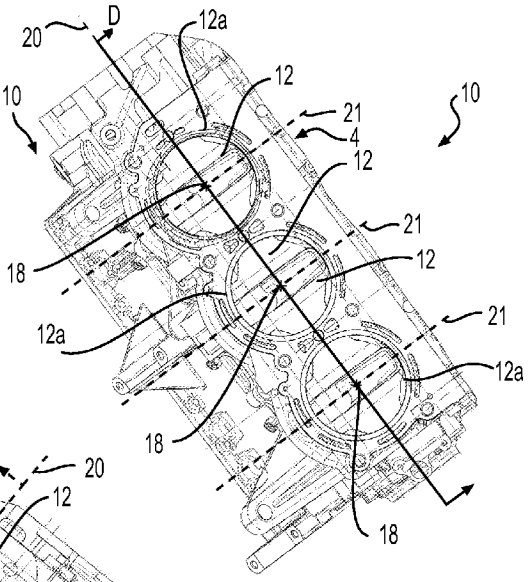
FIG. 1B is a top-right elevation view of the right cylinder bank of the cylinder block of the engine of FIG. 1A.
Figure 1C:
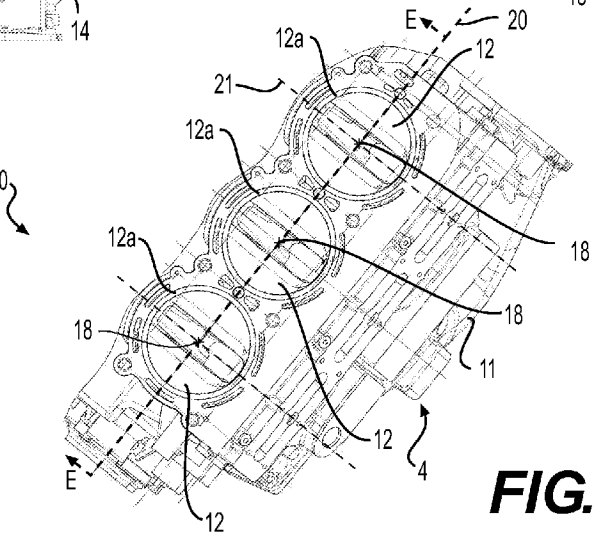
FIG. 1C is a top-left elevation view of the left cylinder bank of the cylinder block of the engine of FIG. 1A.
Figure 1A:
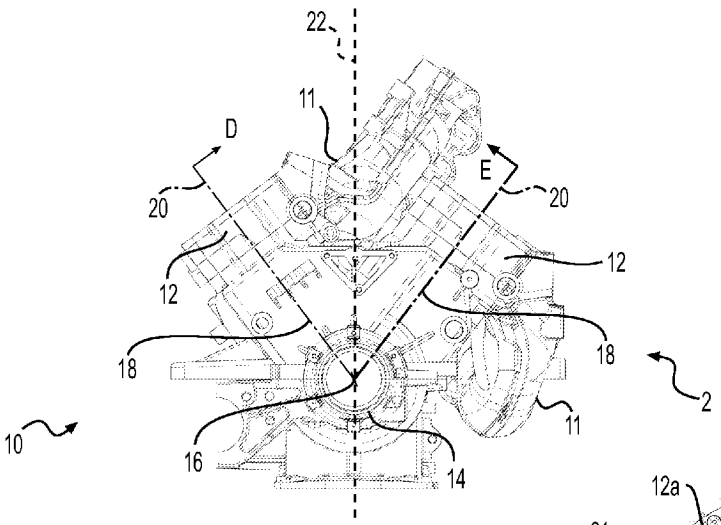
FIG. 1A is a front elevation view of a direct injection, two-stroke, six cylinder, V-type (V6) engine with the cylinder head removed for clarity.

Referring to FIGS. 1A to 1C, the cylinder block 10 defines six cylinders 12 arranged to form a V, with three cylinders 12 being disposed in line on each side of the V-formation to form two cylinder banks. It is contemplated that the cylinder block 10 could have more or less than six cylinders 12. It is also contemplated that the cylinders 12 could have a configuration other than a V-formation, for example, the cylinders 12 could be arranged inline, horizontally—opposed or flat, X and Y configuration. Each bank of cylinders 12 could have more or less than 3 cylinders 12. Other than the V-6 type engine shown herein, examples of other types of engines 2 contemplated include, but are not limited to, inline-1, inline-2, inline-3, Y-9, X-12, flat-4, and the like.

The cylinder block 10 has a crankcase 14 connected to all six cylinders 12. A crankshaft (not shown) is rotatably disposed inside the crankcase 14 along its central axis 16. The crankshaft extends out through a wall of the crankcase 14 to be operatively connected to an element to be driven by the engine 2, such as a propeller of a watercraft, a wheel of a motorcycle or an endless track of a snowmobile. It is also contemplated that the crankshaft could be connected to the input shaft of a transmission providing gear reduction to a wheel, track, propeller and the like.

The cylinders 12 extend from the crankcase 14 such that a central cylinder axis 18 of each of the six cylinders is perpendicular to the central axis 16 of the crankshaft. The three cylinders 12 of each bank of the V-formation are disposed with their cylinder axes 18 aligned in a common plane 20 which also includes the central axis 16. The three cylinders 12 of the right bank extend on the right side of the crankcase 14 such that the right plane 20 defined by the three cylinders 12 of the right arm is disposed at a block bank angle of 37° with respect to a vertical plane 22 containing the central axis 16. It is contemplated that the block bank angle could be between 25° to 50°. Similarly, three cylinders 12 of the left bank of the V-formation extend on the left side of the crankcase to define a left plane 20 containing the three cylinder axes 18 of the left bank cylinders 12 and disposed at an angle of 30° with respect to the vertical plane 22 containing the central axis 16.

A piston (not shown) is disposed inside each cylinder 12 to reciprocate therein along a reciprocation axis that is coaxial with the cylinder axis 18 of the cylinder 12. Each piston is connected to the crankshaft via a connecting rod (not shown) to drive the crankshaft.

The direction parallel to the cylinder axis 18 for each cylinder 12 will be referred to hereinafter as the axial direction. The upward axial direction is defined as proceeding away from the crankcase 14. The downward axial direction is defined as a direction proceeding toward crankcase 14. The portion of the cylinder 12 further away from the crankcase 14 along the axial direction will be referred to as the upper portion of the cylinder 12, and the portion of the cylinder 12 proximal to the crankcase 14 will be referred to as the lower portion of the cylinder 12.

With reference to FIG. 1A to 1C, each cylinder 12 connects to an exhaust manifold 11 on one side to expel exhaust gases resulting from the combustion process occurring in the cylinder 12. In the illustrated embodiment, the exhaust manifold 11 is connected to the left side of each of the cylinders 12 of both banks of the cylinder block 10. The side of each cylinder 12 connected to the exhaust manifold will be referred to herein as the exhaust side 4. The left side exhaust manifold 11 connecting to the left side cylinders 12 curves downwards from the left side cylinders 12 and then rearwards. The right side exhaust manifold 11 connecting to the right side cylinders 12 curves upwards from the left side cylinders 12 and then rearwards. It is contemplated that the exhaust manifold 11 could be configured differently than as shown herein. For example, each exhaust manifold 11 could be connected to the right side of each cylinder 12. It is also contemplated that the exhaust manifold 11 could be connected to each cylinder 12 on a side proximal to the opposite bank of cylinders 12, or each cylinder 12 could be connected to the respective exhaust manifold on a side distal from the opposite bank of cylinders. Therefore, both exhaust manifolds 11 could be disposed between the left and right bank of cylinders 12, or the exhaust manifold 11 for each bank of cylinders 12 could be disposed outside the V, or away from the opposite bank of cylinders.

An inlet manifold (not shown), including a throttle body, is connected to the crankcase 14 to supply air for the combustion process.

Figure 2A:
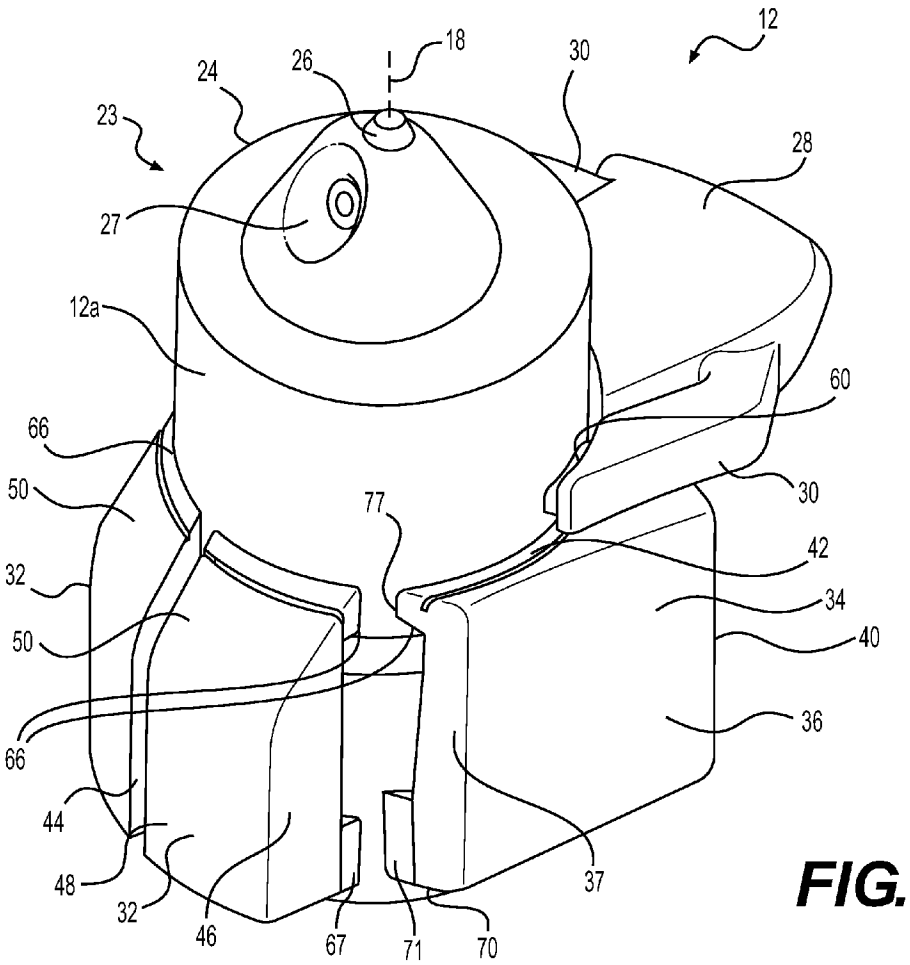
FIG. 2A is a schematic illustration of an internal volume of a cylinder of the cylinder block of the engine of FIG. 1A, showing a perspective view of the cylinder taken from a first end opposite an exhaust side.

With reference to FIG. 2A, each cylinder 12 has a cylinder wall 12*a* and a cylinder axis 18 as mentioned above. The top of the cylinder 12 is closed by a cylinder head 24 disposed thereon. The cylinder head 24 defines the combustion chamber 23 in the upper portion of the cylinder 12. A fuel injector 26, connected to the cylinder head 24 along the cylinder axis 18 of the cylinder 12, supplies fuel to the combustion chamber 23. It is contemplated that the fuel injector 26 could be disposed at an angle with respect to the cylinder axis 18, and/or offset therefrom. A spark plug 27 connected to the cylinder head 24 ignites the fuel-air mixture in the combustion chamber 23. It is contemplated that the cylinder heads 24 of all six cylinders 12, or all of the three cylinders 12 of each arm, could be formed integrally.

Figure 2B:
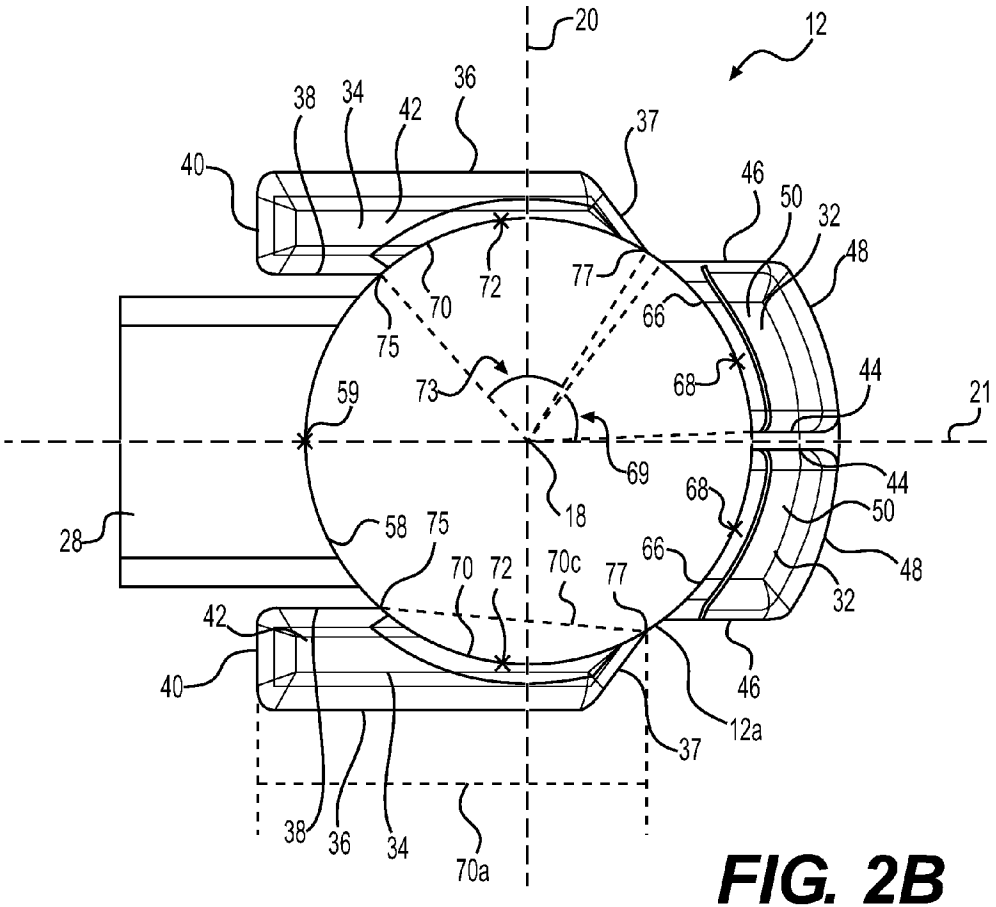
FIG. 2B is a schematic top plan view of the internal volume of the cylinder of FIG. 2A with portions of the internal volume corresponding to auxiliary exhaust passages being removed for clarity.

With reference to FIGS. 2A and 2B, each cylinder 12 has a central exhaust passage 28 extending outwards from the cylinder 12 to connect to the exhaust manifold 11. An auxiliary exhaust passage 30, on each side of the central exhaust passage 28, extends between the cylinder 12 and the exhaust passage 28. The exhaust passage 28 defines an exhaust side 4 of the cylinder 12. On the end 5 opposite the exhaust side 4, the cylinder 12 has two central transfer channels 32 extending between the upper and lower portions of the cylinder 12. The upper and lower portions of the cylinder 12 are also connected by side transfer channels 34 disposed along the cylinder 12 between the exhaust passage and the central transfer ports.

As will be described below, each of the central exhaust passage 28, each auxiliary exhaust passage 30, each central transfer channel 32 and each side transfer channel 34 connects to the cylinder 12 through an associated port defined in the cylinder wall 12*a*.

With reference to FIGS. 2A to 6, the cylinder 12 and the ports defined in the inside wall 12*a* of the cylinder 12 will now be described in more detail.

The cylinder wall 12*a* has defined therein a central exhaust port 58, a pair of auxiliary exhaust ports 60, a right central transfer port 66 and a left central transfer port 66, and a right side transfer port 70 and a left side transfer port 70.

Figure 3:
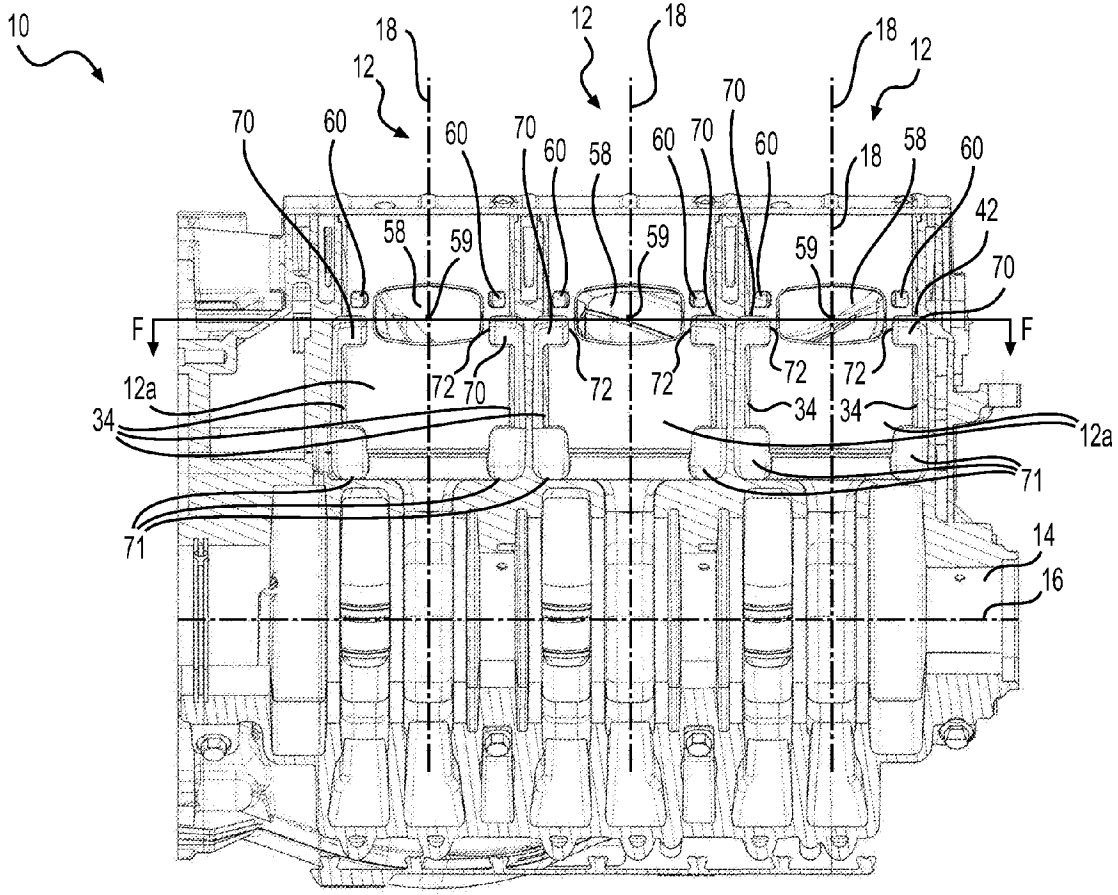
FIG. 3 is a cross-sectional view of the left cylinder bank of the cylinder block of FIG. 1B taken along the line D-D of FIG. 1B, showing an exhaust port, two auxiliary exhaust ports, and a portion of two side transfer ports in each cylinder.

With reference to FIG. 3, two auxiliary exhaust ports 60 are disposed on either side of the central exhaust port 58. The upper edges of the two auxiliary exhaust ports 60 and the central exhaust port 58 are aligned in the axial direction.

The central and auxiliary exhaust ports 58, 60 are generally rectangular in shape with rounded corners. The auxiliary exhaust ports 60 are considerably smaller in size (surface area) than the central exhaust port 58. It is also contemplated that there could be more or less than two auxiliary exhaust ports 60. It is contemplated that the auxiliary exhaust ports 60 could be omitted. It is contemplated that the shapes and sizes of the exhaust port 58 and the auxiliary exhaust ports 60 could be different.

The exhaust manifold 11 is connected to each cylinder 22 via the exhaust passages 28, 30 and exhaust ports 58, 60. An exhaust valve passage 29 (FIG. 5) connecting to the exhaust ports 58 is also defined on the exhaust side 4 of the cylinder 22. An exhaust valve assembly (not shown) included in the exhaust valve passage 29 is configured to change the effective surface areas of the exhaust port 58 and of the auxiliary exhaust ports 60 depending on the operating conditions of the engine 10. It is contemplated that the exhaust valve assembly, and therefore its associated exhaust valve passage 29 could be omitted. An example of an exhaust valve assembly can be found in U.S. Pat. No. 7,762,220, issued Jul. 27, 2010, the entirety of which is incorporated herein by reference.

Figure 4:
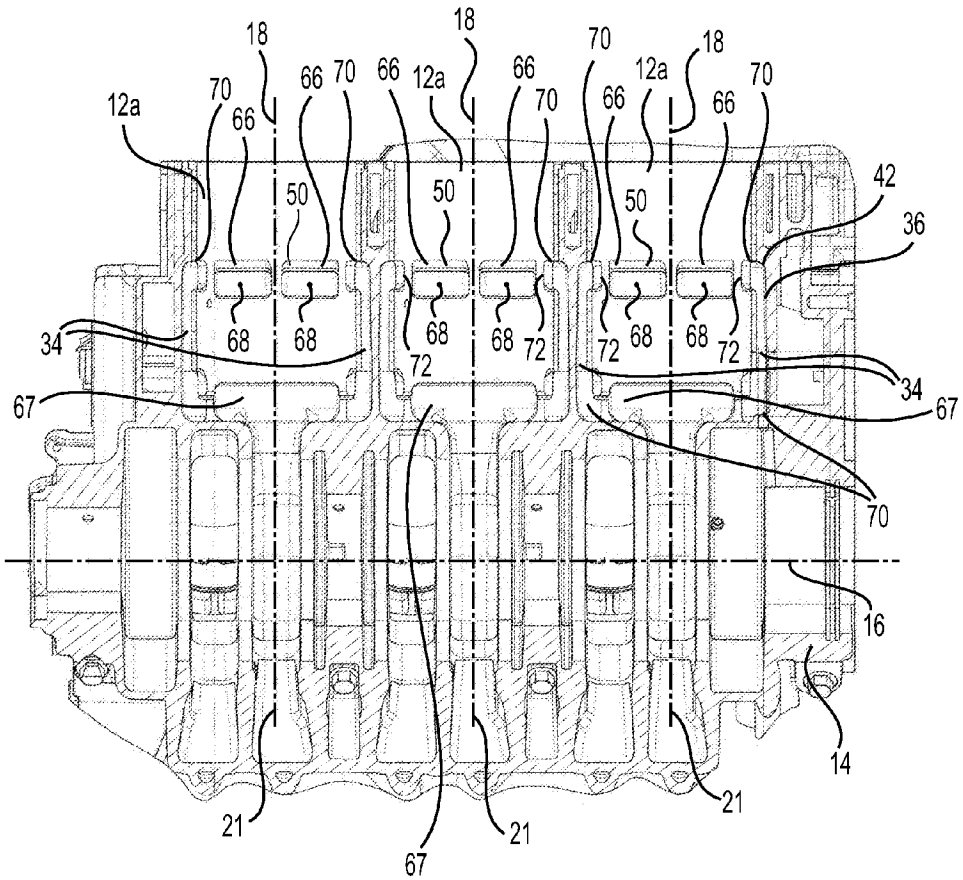
FIG. 4 is a cross-sectional view of right cylinder bank of the cylinder block of FIG. 1C, taken along the line E-E of FIG. 1C, showing two central transfer ports, and a portion of two side transfer ports in each cylinder.

With reference to FIGS. 2A, 2B and 4, a left and right central transfer port 66 are defined in the cylinder wall 12*a* and connected to the central transfer channels 32. The left and right central transfer port 66 are each defined on the cylinder wall 12*a* on the side opposite to the exhaust ports 58, 60. The left and right central transfer ports 66 are disposed symmetrically with respect to the exhaust port 58. The left and right central transfer ports 66 are each disposed respectively to the left and right of the plane 21 defined by the center of the exhaust port 58 and the cylinder axis 18. The transfer channels 32 (seen in FIG. 2), extending from the right and left central transfer ports 66 in the upper portion of the cylinder 12, are connected to the crankcase 14 by a port 67 which extends the width of the both central transfer channels 32. Air in the crankcase 14 and the lower portion of the cylinder 22 thus flows through the lower port 67, the transfer channels 32 and the central transfer ports 66 to the combustion chamber 23.

With reference to FIGS. 2A to 5, side transfer ports 70 are also defined in the wall of the cylinder 22. Left and right side transfer ports 70 are each defined between the exhaust port 58 and the respective left and right central transfer ports 66. The side transfer ports 70 are connected to the side transfer channels 34. The transfer channels 34 are connected to the lower portion of the cylinder 12 via a lower transfer port 71, and thereby to the crankcase 14. Air in the crankcase 14 and the lower portion of the cylinder 12 thus flows through the ports 71, the side transfer channels 34 and the side transfer ports 70 to enter the combustion chamber 23.

Figure 5:
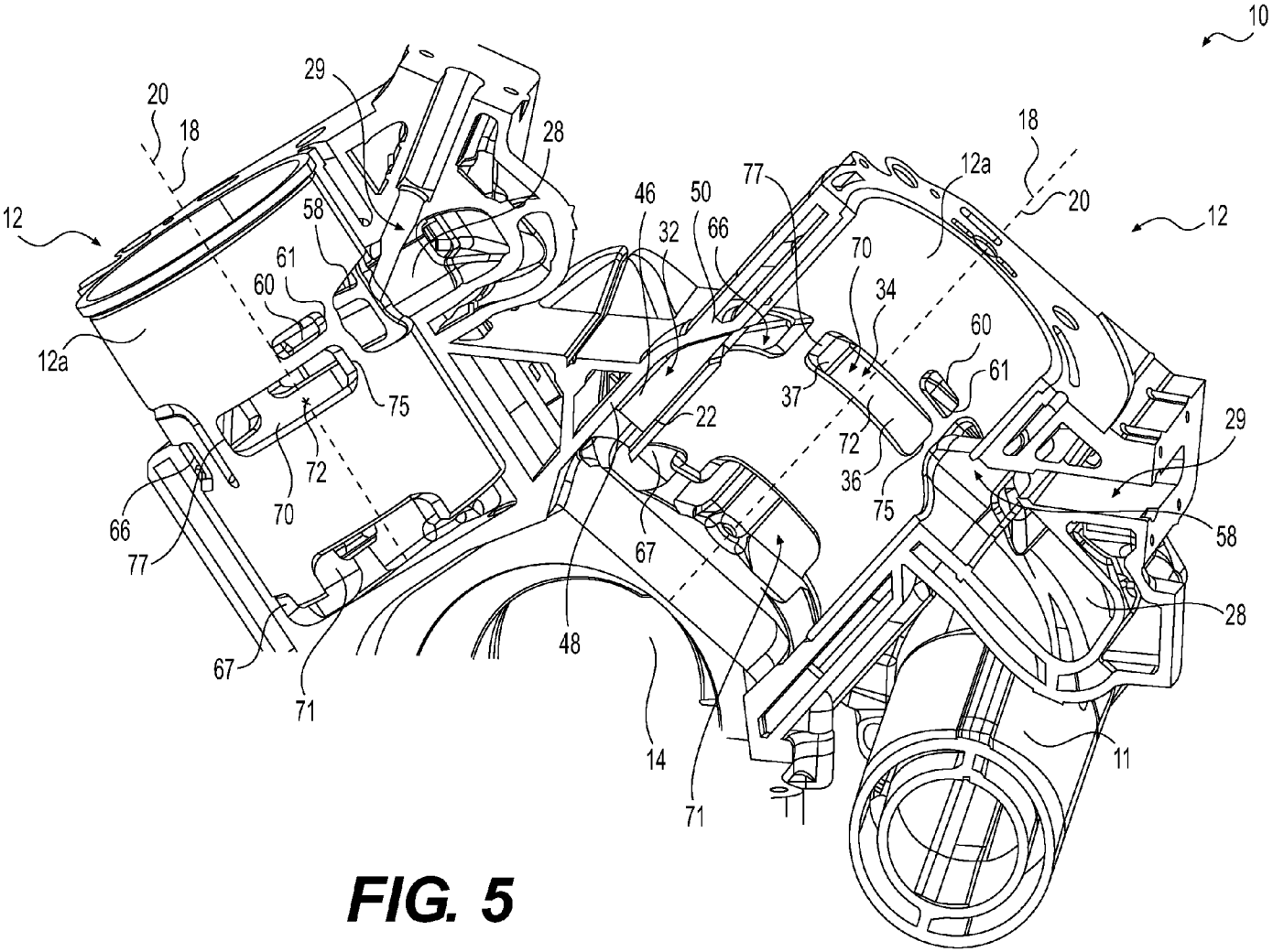
FIG. 5 is a partially cut-away perspective view, taken from a front, left side of the cylinder block of FIG. 1A.

With reference to FIGS. 3, and 5, in the axial direction, the center 68 of the central transfer ports 66 and the center 72 of the side transfer ports 70 are disposed lower than the center 59 of the central exhaust port 58. The axially upper edges of the transfer ports 66, 70 are disposed at a lower axial position than the axially upper edge of the exhaust port 58. The side transfer port 70 and the auxiliary exhaust port 60 are aligned along their respective lateral edges 75, 61 parallel to the axial direction and proximal to the exhaust port 58. The side transfer port 70 also has a distal edge 77 (best seen in FIG. 5) that is disposed parallel to the axial direction 18 and farther away from the exhaust port 58 than the proximal edge 75.

The side and central transfer ports 66, 70 are generally rectangular in shape and smaller in surface area than the generally rectangular exhaust port 58. The surface area of each central transfer port 66 is smaller than that of the exhaust port 58. The surface area of each side transfer port 70 is smaller than that of the exhaust port 58.

Defining the center 59 of the exhaust port 58 as corresponding to the 0° position with respect to the cylinder axis 18, the angular span of the transfer ports 66, 70 along the circumference of each port 58, 60, 66, 70 can be described with respect to their respective edges extending in the axial direction.

With reference to FIG. 2B, each central transfer port 66 extends from 131° to 177° on their respective sides with respect to the exhaust port center 59. Thus, each central transfer port 66 has an angular span 69 of 46° along the circumference of the cylinder wall 12*a*. The center 68 of each central transfer port 66 forms an angle of 154° with respect to the exhaust port center 59. The bridge formed by the cylinder wall 22 between the two central transfer ports 66 has an angular span of about 6°. The bridge enhances the structural stability of the cylinder 12. It is contemplated that the bridge could be omitted to form a single continuous central transfer port, with its center 68 disposed at an angle of 180° opposite the exhaust port center 59 (as in the embodiment of FIGS. 7A and 7B).

Each side transfer port 70 extends from 43° to 115° on their respective sides with respect to the exhaust port center 59. Thus, each side transfer port 70 has an angular span 73 of 72° along the circumference of the cylinder wall 12*a* between the edges 75, 77. The center 72 of each side transfer port 70 forms an angle of 79° with respect to the exhaust port center 59. It is contemplated that the positions and spans of the side transfer ports 70, the central transfer ports 66 and the bridge formed therebetween could be different than as shown herein.

For ports having a shape other than rectangular, it will be understood that the center of the transfer ports 66, 70 can be defined by the geometric center of the shape. The angular span of the ports is defined by its edges or points located at the largest angle about the cylinder axis 18 with respect to the center of the port.

With reference to FIGS. 2A, 2B, 3, and 4, the side transfer channel 34 is defined by two side walls 36, 38, a rear wall 40, and an upper wall 42 (indicated for the side transfer port 70 farthest to the right in FIGS. 3 and 4).

Figure 6:
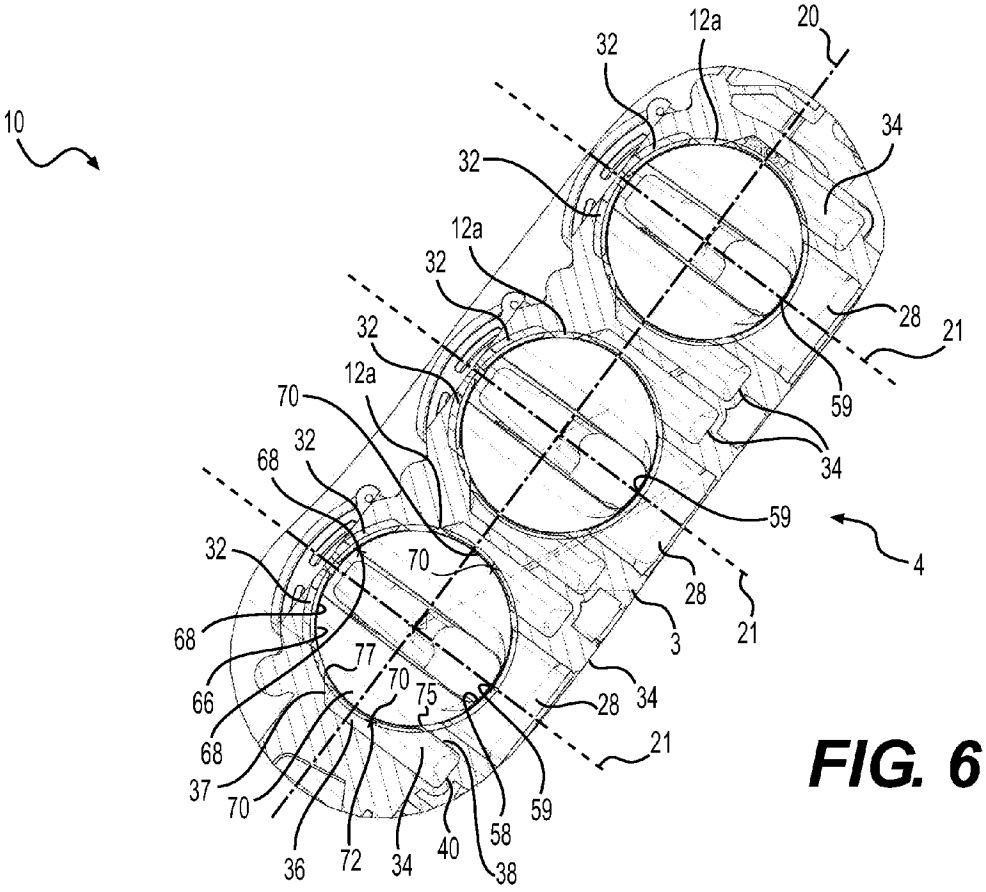
FIG. 6 is a cross-sectional view of the cylinder block of FIG. 1A, taken along the line F-F of FIG. 3, showing two side transfer ports and two central transfer ports in each cylinder with their respective transfer channels.

As best seen in FIGS. 2B and 6, when viewed along an axial direction, the side walls 36, 38 are parallel to each other and extend from the edges 75, 77 of the side transfer port 70 that are parallel to the cylinder axis 18. The rear wall 40 is planar and perpendicular to the side walls 36, 38. It is contemplated that the rear wall 40 could be curved instead of planar.

The side walls 36, 38 extend at a non-perpendicular angle from the adjacent cylinder wall 12*a*. The side wall 38 is connected to the proximal edge 75 of the transfer port 70. The side wall 38 is parallel to the plane 21 defined by the center of the exhaust port 59 and the cylinder axis 18. The side wall 38 extends at an acute angle with respect to the cylinder wall 12*a* adjacent to the proximal edge 75. The side wall 36 is connected to the distal edge 77 of the transfer port 70. A majority of the side wall 36 is parallel to the plane 21. The side wall 36 has a portion 37, extending to the distal edge 77, that is angled away from the exhaust port 58 toward the central transfer port 66. The angled portion 37 extends at an obtuse angle with respect to the portion of the cylinder wall 12*a* adjacent to the distal edge 77. The angled portion 37 extends at an acute angle with respect to a chord 70*c* joining the edges 75, 77 of the transfer port 70.

In the plane normal to the cylinder axis 18, the distal edge 77 of the transfer port 70 and the rear wall 40 are disposed on opposite sides of the proximal edge 75 of the transfer port 70. The length of the side wall 36 including the portion 37 is greater than the length of the chord 70*c*.

In the plane normal to the cylinder axis 18, the length 70*a* of the transfer channel 34 can be defined as the distance between the rear wall 40 and the distal edge 77 of the transfer port 70 in the direction parallel to the plane 21, the side wall 38 and the side wall 36 excluding the angled portion 37. If the side walls 36, 38 are not parallel to the plane 21, the length of the transfer channel 34 in the plane normal to the cylinder axis 18 is measured in the direction parallel to the mutually parallel portions of the side wall 38 and the side wall 36 excluding the angled portion 37. As can be seen in FIG. 2B, length 70*a* of the transfer channel 34 is greater than the chord 70*c*.

As best seen in FIGS. 2A, 3 and 4, the upper wall 42 of each side transfer port extends from the upper edge of the side transfer port 70 perpendicularly to the cylinder wall 12*a*. The upper wall 42 extends between the side walls 36, 38 and to the rear wall 40. The side transfer channel 34 thus has a generally rectangular cross-section and extends out of the cylinder 12 at an angle so as to direct air into the cylinder 12 towards the central transfer ports 66 on the cylinder wall 12*a* opposite the exhaust port 58.

With reference to FIGS. 2A, 2B, 3 and 4, the side walls 36, 38 and the rear wall 40 extend in the axial direction from the upper edge of the side transfer port 70 to the lower port 71 in the lower portion of the cylinder 12. Each side transfer channel 34 is thus also defined by a portion of the outer surface of the cylinder wall 12*a* extending between the side transfer port 70 and the lower port 71.

With reference to FIGS. 2A to 6 and 8B, the central transfer channel 32 is defined by two side walls 44, 46, a rear wall 48, and an upper wall 50 (seen in FIGS. 2A and 5). The side walls 44, 46 are parallel to each other and extend from the periphery of the central transfer port 66. The side walls 44, 46 are also parallel to the plane 21 defined by the center of the exhaust port 59 and the cylinder axis 18. The rear wall 48, extending between the side walls 44, 46, is curved and coaxial with the central transfer port 66 and the cylinder 12.

As best seen in FIGS. 2A and 5, the side walls 44, 46 and the rear wall 48 extend in the axial direction to the lower port 67 in the lower portion of the cylinder 12 connected to the crankcase 14. A portion of the outer surface of the cylinder wall 12*a* between the central transfer port 66 and the lower port 67 thus defines the central transfer channel 32.

As best seen in FIGS. 2A, 2B and 5, the upper wall 50 extends between the side walls 44, 46, from the upper edge of the central transfer port 66 to the rear wall 48. The upper wall 50 does not extend normal to the axial direction and the cylinder wall 12*a*, but at an angle thereto. The upper wall 50 extends from the rear wall 48 of the central transfer port 66 toward the upper edge of the central transfer port 66 at an acute angle to the axially upward direction. The central transfer channel 32 thus directs air into the cylinder 12 upwards towards the exhaust port 58 on the cylinder wall 12*a* opposite thereto.

As the piston (not shown) reciprocates in the cylinder 22, it opens and closes the central and side transfer ports 66, 70, the exhaust ports 58, 60, and the pair of auxiliary exhaust ports 60, in a manner commonly known in two-stroke internal combustion engines. When the piston is disposed in the upper portion of the cylinder 22, the lower ports 67, 71 are open, and the transfer ports 66, 70 and exhaust ports 58, 60 are closed so that air from the crankcase fills the lower portion of the cylinder 12. As the piston descends towards the crankcase 14, it first travels past the exhaust ports 58, 60 and then the transfer ports 66, 70 to open them in that order. Air from the lower portion of the cylinder 12 is thereby allowed to flow into combustion chamber 23 to mix with the fuel injected therein. Some of the unburnt fuel remaining in the combustion chamber 23 after the previous combustion cycle is pushed out into the exhaust passage 28. When the piston moves upwards towards the combustion chamber 23, the air therein is compressed and exhaust gases are expelled out of the exhaust ports 58, 60. Air is prevented from flowing out through the transfer channels 32, 34 by a one-way valve such as a reed valve disposed in the air intake manifold through which air is delivered to crankcase 14 and the transfer channels 32, 34.

This design of the transfer ports 66, 70 and the transfer channels 32, 34 described above helps to balance the competing goals of minimizing fuel lost from the exhaust port and optimizing mixture of the fuel injected into the combustion chamber 23 by the fuel injector 26 and air flowing into the combustion chamber 23 from the crankcase 14.

Figure 7A:
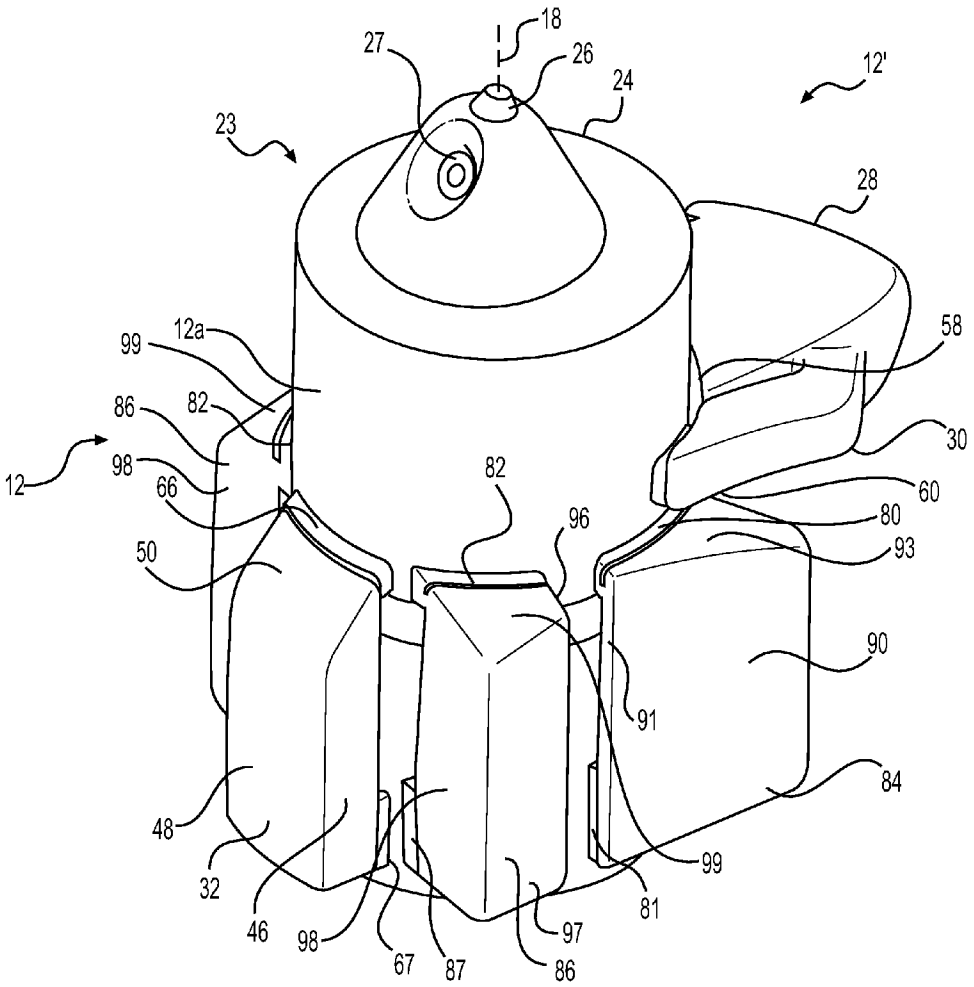
FIG. 7A is a schematic illustration of an internal volume of another embodiment of a cylinder of a direct injection, two-stroke internal combustion engine, showing a perspective view of the cylinder taken from a first end opposite an exhaust side.
Figure 7B:
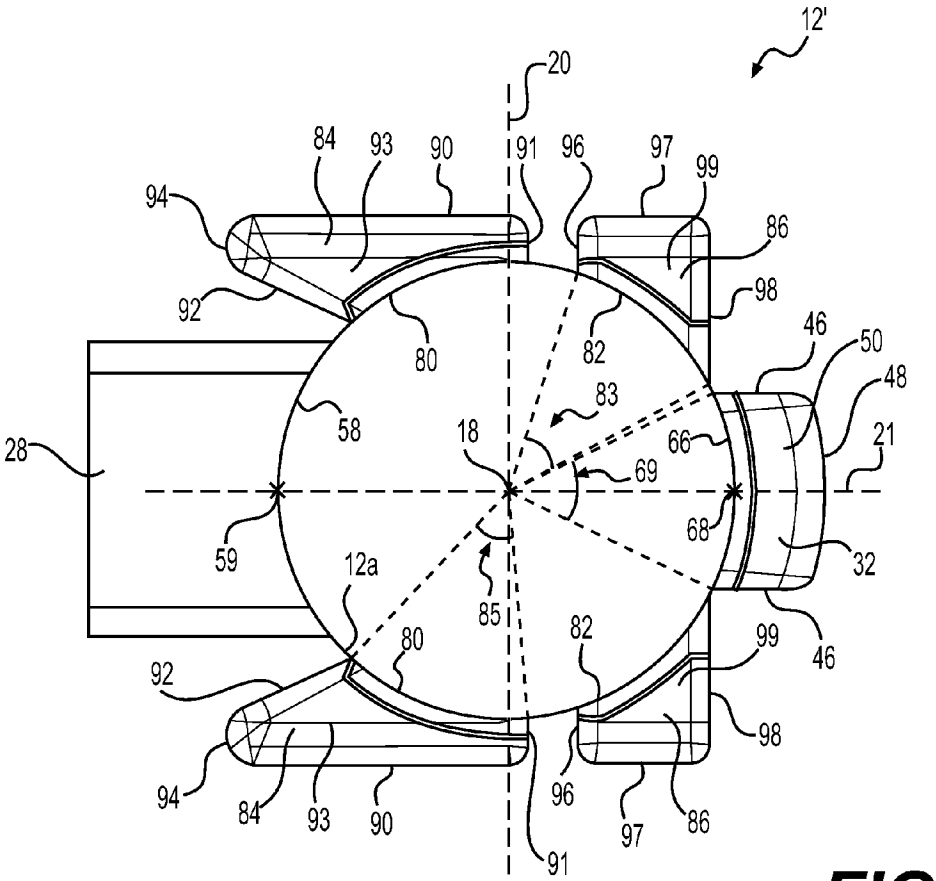
FIG. 7B is a schematic top plan view of the internal volume of the cylinder of FIG. 7A with portions of the internal volume corresponding to the auxiliary exhaust passages being removed for clarity.

Turning now to FIGS. 7A and 7B, an alternative embodiment 12' of the cylinder 12 will be described. The components of the cylinder 12' that are similar to that of the cylinder 12 have been labeled with the same reference numerals. The cylinders 12 and 12' mainly differ in the configuration of transfer ports. As such, and for simplicity, only these transfer ports will be described below and the other features of the cylinder 12' will not be described in detail.

The cylinder 12' has a single central transfer port 66 on the cylinder wall 12*a* opposite the exhaust port 58. The cylinder 12 has two side transfer ports 80, 82 defined on each side of the cylinder wall 12*a* between the exhaust port 58 and the central transfer port 66.

The single central transfer port 66 in the upper portion of the cylinder 12 is connected to the port 67 in the lower portion of the cylinder 12' via a central transfer channel 32. The central transfer port 66 is defined on the cylinder wall 12*a* opposite to the exhaust port 58. The cylinder axis 18 is disposed between the center 59 of the exhaust port 58 and the center 68 of the central transfer port 66. The center 68 of the central transfer port 66 is thus disposed in the plane 21. The single central transfer channel 32 is defined by two side walls 46, a rear wall 48, and an upper wall 50 and is similar to each of the two central transfer channels 32 of the cylinder 12'. The side walls 46 extend from the periphery of the central transfer port 66. The side walls 46 are parallel to each other and to the plane 21. The rear wall 48, extending between the side walls 46, is curved and coaxial with the cylinder axis 18. The upper wall 50 extends between the side walls 46, from the upper edge of the central transfer port 66 to the rear wall 48. The plane 21 passes through the rear wall 48 and the upper wall 50. The upper wall 50 extends at a non-normal angle to the cylinder axis 18 and the cylinder wall 12*a*. The upper wall 50 extends from the rear wall 48 of the central transfer port 66 toward the upper edge of the central transfer port 66 at an acute angle to the axially upward direction. The central transfer channel 32 thus directs air into the cylinder 12' upwards towards the exhaust port 58 on the cylinder wall 12*a* opposite thereto.

Each first side transfer port 80 is closer to the exhaust port 58 than the second side transfer port 82 on that side. A side transfer channel 84 connects the side transfer port 80 in the upper portion of the cylinder 12 with a port 81 in the lower portion of the cylinder 12. The transfer channel 84 has two side walls 90, 92 extending from the axial edges of the transfer port 80. The side wall 90 is parallel to the plane 21 defined by the exhaust port 58 and the cylinder axis 18. The side wall 90 has a portion 91 adjacent to the side transfer port 80 which extends normal to the plane 21. A rear wall 94 extends between the side walls 90, 92 which converge towards one another as they extend away from the side transfer port 80. An upper wall 93 extends perpendicularly to the cylinder axis 18 between the walls 90, 92, 94 and the side transfer port 80.

Each second side transfer port 82 is farther from the exhaust port 58, disposed between the corresponding first side transfer port 80 of that side and the central transfer port 66. A side transfer channel 86 connects the side transfer port 82 in the upper portion of the cylinder 12 with a port 87 in the lower portion of the cylinder 12. The transfer channel 86 has two side walls 96, 98 extending from the axial edges of the transfer port 82. The side walls 96, 98 are parallel to one another and perpendicular to the plane 21. A rear wall 97 extends between the parallel side walls 96, 98. An upper wall 99 extends perpendicularly to the cylinder axis 18 between the walls 96, 97, 98 and the side transfer port 82.

With reference to FIG. 7B, the central transfer port 66 spans from 156° to 180° on each side with respect to the exhaust port center 59 to form a single continuous central transfer port, with its center 68 disposed at an angle of 180° opposite the exhaust port center 59. Thus, the central transfer port 66 has an angular span 69 of 48° along the circumference of the cylinder wall 12*a*.

Each first side transfer port 80 has an angular span 85 along the cylinder wall of 47°, extending from 47° to 94° on their respective sides with respect to the exhaust port center 59. Each second side transfer port has an angular span 83 along the cylinder wall of 39°, extending from 110° to 149° on their respective sides with respect to the exhaust port center 59.

The transfer ports 66, 80, 82, and the transfer channels 32, 84, 86 of the cylinder 12' are configured to optimize mixing of fuel and air in the combustion chamber 23, the fuel and air being respectively delivered therein from the fuel injector 27 and the crankcase 14.

Figure 8B:
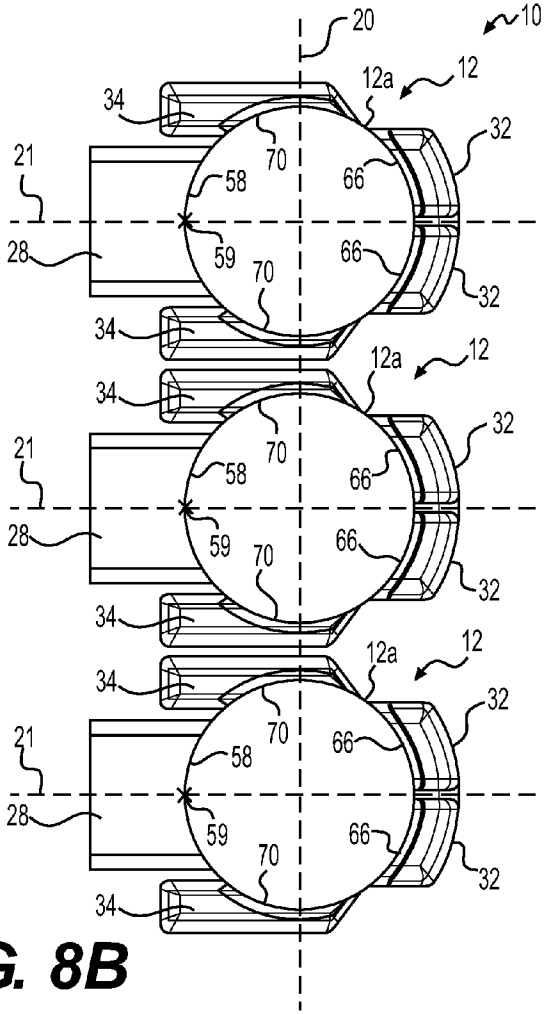
FIG. 8B is a schematic illustration showing a top plan view of an internal volume of a cylinder block having three cylinders, according to the embodiment of FIG. 2A, disposed in an unnested configuration with portions of the internal volume corresponding to the auxiliary exhaust passages being removed for clarity.
Figure 8A:
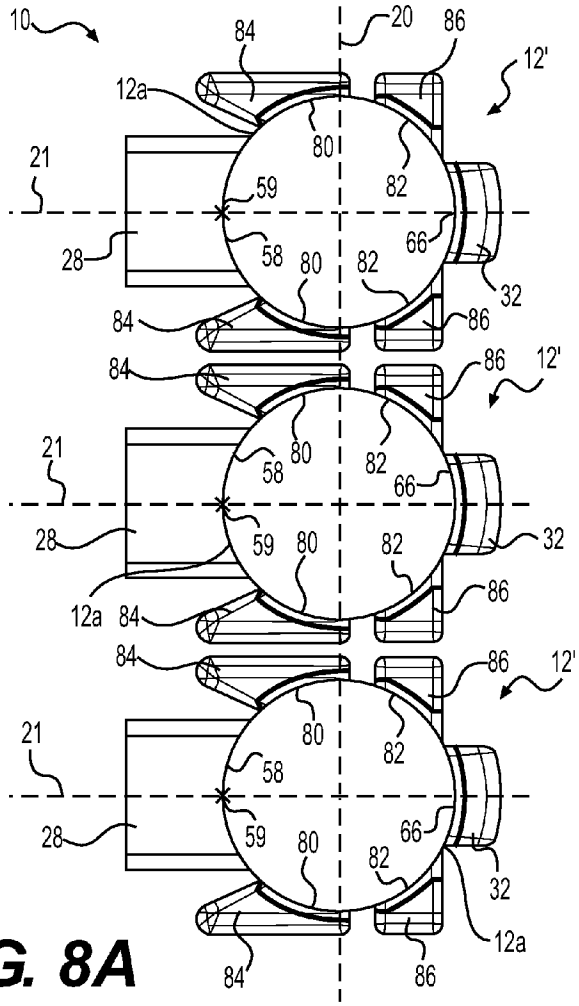
FIG. 8A is a schematic illustration showing a top plan view of an internal volume of a cylinder block having three cylinders, according to the embodiment of FIG. 7A, disposed in an unnested configuration with portions of the internal volume corresponding to auxiliary exhaust passages being removed for clarity.

With reference to FIGS. 8A and 8B, the cylinders 12, 12' are disposed in an unnested configuration with the plane 20 being perpendicular to the plane 21 when the cylinders 12, 12' are placed in line and adjacent to one another. A cylinder block 10 is also contemplated where the cylinders 12, 12' could be arranged in a nested configuration (i.e. with the plane 20 being at an angle other than perpendicular to the plane 21 when the cylinders 12, 12' are placed in line and adjacent to one another).

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A cylinder for an internal combustion engine, the cylinder comprising:

a cylinder axis;

a cylindrical wall;

an exhaust port defined in the cylindrical wall;

a first plane containing the cylinder axis and a center of the exhaust port;

at least one central transfer port defined in the cylindrical wall, each of the at least one central transfer port having a transfer channel extending therefrom, for each of the at least one central transfer port, an angle about the cylinder axis between a center of the central transfer port and the center of the exhaust port being greater than 135° and less than or equal to 180°; and at least two side transfer ports defined in the cylindrical wall, each of the at least two side transfer ports having a transfer channel extending therefrom, for each of the at least two side transfer ports, an angle about the cylinder axis between a center of the side transfer port and the center of the exhaust port being less than or equal to 135°, the at least two side transfer ports including a left side transfer port and a right side transfer port disposed circumferentially symmetrically with respect to the exhaust port, for each of the left side transfer port and the right side transfer port, a corresponding transfer channel being defined in part by a side transfer channel wall extending away from a corresponding one of the left side transfer port and the right side transfer port and extending in a direction parallel to the first plane containing the cylinder axis and a center of the exhaust port, the exhaust port being disposed at least in part between the side transfer channel wall extending from the left side transfer port and the side transfer channel wall extending from the right side transfer port such that a second plane extending parallel to the cylinder axis and containing a left edge of the exhaust port and a right edge of the exhaust port intersects the side transfer channel wall extending from the left side transfer port and the side transfer channel wall extending from the right side transfer port.

2. The cylinder of claim 1, wherein for each of the at least two side transfer ports, the corresponding transfer channel is defined by at least one wall adapted to guide air flow into the cylinder towards the at least one central transfer port.

3. The cylinder of claim 1, wherein for each of the at least one central transfer port, the corresponding transfer channel is defined by at least one wall adapted to direct air flow into the cylinder toward the exhaust port.

4. The cylinder of claim 1, wherein each transfer channel is defined by:

an outer surface of the cylindrical wall adjacent to the corresponding one of the at least one central transfer port and the at least two side transfer ports;

two side walls extending from a periphery of the corresponding one of the at least one central transfer port and the at least two side transfer ports;

a rear wall extending between the two side walls and spaced from the outer surface; and an upper wall extending from the periphery of the corresponding one of the at least one central transfer port and the at least two side transfer ports between the two side walls and the rear wall, for each of the left side transfer port and the right side transfer port, the side transfer channel wall extending therefrom and extending in the direction parallel to the first plane containing the cylinder axis and the center of the exhaust port being one of the two side walls.

5. The cylinder of claim 4, wherein for each transfer channel:

the rear wall and the two side walls extend generally parallel to the cylinder axis.

6. The cylinder of claim 4, wherein for each transfer channel corresponding to the left side transfer port and the right side transfer port of the at least two side transfer ports:

a first portion of an other of the two side walls extends parallel to the first plane containing the cylinder axis and the center of the exhaust port, the exhaust port being disposed at least in part between the first portion of the other of the two side walls of the left side transfer port and the first portion of the other of the two side walls of the right side transfer port such that the second plane intersects the first portion of the other of the two side walls extending from the left side transfer port and the first portion of the other of the two side walls extending from the right side transfer port.

7. The cylinder of claim 6, wherein for each transfer channel corresponding to the left side transfer port and the right side transfer port of the at least two side transfer ports:

the other of the two side walls has a second portion extending between the first portion and the corresponding side transfer port;

a chord is defined by the periphery of the corresponding side transfer port, the chord being disposed perpendicular to the cylinder axis; and an angle between the second portion and the chord is less than or equal to 90°.

8. The cylinder of claim 6, wherein for each transfer channel corresponding to the left side transfer port and the right side transfer port of the at least two side transfer ports:

the rear wall is perpendicular to the two side walls.

9. The cylinder of claim 4, wherein for each transfer channel corresponding to the at least one central transfer ports:

an angle between the upper wall and the rear wall is greater than 90°.

10. The cylinder of claim 1, wherein:

the at least one central transfer port includes a left central transfer port and a right central transfer port disposed circumferentially symmetrically with respect to the exhaust port.

11. The cylinder of claim 10, wherein the angle about the cylinder axis between the centers of the left central transfer port and the right central transfer port is less than 90°.

12. The cylinder of claim 10, wherein:

for each of the left side transfer port and the right side transfer ports, the angle about the cylinder axis between the centers of the exhaust port and a corresponding one of the left side transfer port and the right side transfer port is less than 90°.

13. The cylinder of claim 10, wherein:

the surface area of each of the left side transfer port and the right side transfer port of the at least two side transfer ports is larger than the surface area of each of the at least one central transfer port.

14. An internal combustion engine, comprising:

at least one cylinder according to claim 1;

a crankcase connected to the at least one cylinder;

an intake port fluidly connected to the crankcase;

a cylinder head connected to the at least one cylinder; and further comprising, for each of the at least one cylinder:

a piston disposed inside the cylinder and adapted to reciprocate along the cylinder axis;

a combustion chamber defined by the cylinder, the piston and the cylinder head;

a fuel injector fluidly connected to the combustion chamber; and a spark plug disposed at least in part in the combustion chamber, the at least one central transfer port and the at least two side transfer ports selectively connecting the crankcase with the combustion chamber.

15. The engine of claim 14, wherein:

the at least one cylinder comprises at least two adjacent cylinders;

the at least two adjacent cylinders being disposed such that their respective cylinder axes are parallel to one another; and lines connecting the centers of the exhaust ports with their corresponding cylinder axes are normal to a plane defined by the cylinder axes of the at least two adjacent cylinders.

16. A cylinder block for an internal combustion engine comprising:

a crankcase having a central axis; and a plurality of cylinders according to claim 1;

the cylinder axes of the plurality of cylinders defining a plane, the plane defined by the cylinder axes of the plurality of cylinders containing the central axis of the crankcase, and the crankcase being connected to each of the transfer channels corresponding to each of the at least one central transfer port and each of the at least two side transfer ports.

17. The cylinder of claim 1, wherein:

an angle about the cylinder axis between the center of the exhaust port and a corresponding center of each of the left side transfer port and the right side transfer port is less than 90°.

18. The cylinder of claim 1, wherein for each of the left side transfer port and the right side transfer port, the corresponding transfer channel extends in a direction away from the at least one central transfer port.

19. The cylinder of claim 1, wherein the exhaust port is disposed at least in part between the side transfer channel wall extending from the left side transfer port and the side transfer channel wall extending from the right side transfer port such that the side transfer channel wall of the left side transfer port and the side transfer channel wall of the right side transfer port are intersected by a third plane, the third plane extending parallel to the second plane and containing a center of the exhaust port.

* * * * *